US010408013B2

(12) United States Patent
Al-Mumen et al.

(10) Patent No.: US 10,408,013 B2
(45) Date of Patent: Sep. 10, 2019

(54) WELLBORE PARTED CASING ACCESS TOOL

(71) Applicant: Saudi Arabian Oil Company, Dhahran (SA)

(72) Inventors: Adib A. Al-Mumen, Dammam (SA); Abdullah E. Noaimi, Dhahran (SA); Ibrahim A. Al-Obaidi, Khobar (SA); Nelson O. Pinero Zambrano, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 124 days.

(21) Appl. No.: 15/624,163

(22) Filed: Jun. 15, 2017

(65) Prior Publication Data

US 2018/0363411 A1 Dec. 20, 2018

(51) Int. Cl.

| | |
|---|---|
| ***E21B 33/13*** | (2006.01) |
| ***E21B 17/00*** | (2006.01) |
| ***E21B 47/00*** | (2012.01) |
| ***E21B 23/12*** | (2006.01) |
| ***E21B 29/00*** | (2006.01) |

(52) U.S. Cl.

CPC ..... *E21B 33/13* (2013.01); *E21B 17/00* (2013.01); *E21B 23/002* (2013.01); *E21B 29/00* (2013.01); *E21B 47/0002* (2013.01)

(58) Field of Classification Search

CPC ..... E21B 33/13; E21B 17/00; E21B 23/002; E21B 29/00; E21B 47/0002

See application file for complete search history.

(56) References Cited

U.S. PATENT DOCUMENTS

| | | | |
|---|---|---|---|
| 1,054,232 | A | 2/1913 | Mills |
| 1,455,314 | A | 5/1923 | Watkins |

(Continued)

FOREIGN PATENT DOCUMENTS

| | | |
|---|---|---|
| EP | 418057 A1 | 3/1991 |
| WO | 99/45232 | 9/1999 |
| WO | 2015088553 | 6/2015 |

OTHER PUBLICATIONS

International Search Report and Written Opinion issued in International Application No. PCT/US2018/036887 dated Oct. 8, 2018, 16 pages.

*Primary Examiner* — Zakiya W Bates
*Assistant Examiner* — Crystal J Miller
(74) *Attorney, Agent, or Firm* — Fish & Richardson P.C.

(57) ABSTRACT

A wellbore tool includes a rotatable elongate pipe that includes a first elongate portion extending along a longitudinal axis of the elongate pipe. A first bending portion with a first end attaches to a downhole end of the first elongate portion. The first bending portion deviates from a longitudinal axis of the first elongate portion in a first direction. A second bending portion has a first end attached to a second end of the first bending portion. The second bending portion is positioned downhole of the first bending portion. The second bending portion deviates towards the longitudinal axis in a second direction different from the first direction. The first bending portion and the second bending are eccentric relative to the first elongate portion. The wellbore tool is rotated a set amount and stabbed in a downhole direction until the wellbore tool enters the parted casing.

8 Claims, 6 Drawing Sheets

(56) References Cited

U.S. PATENT DOCUMENTS

| | | | | |
|---|---|---|---|---|
| 1,617,303 | A | 2/1927 | Dougherty | |
| 1,621,947 | A | 3/1927 | Moore | |
| 1,645,010 | A | 10/1927 | Kinley | |
| 1,678,829 | A | 7/1928 | Scott et al. | |
| 1,749,380 | A | 3/1930 | Hinderliter | |
| 1,794,562 | A | 3/1931 | Taylor | |
| 2,011,036 | A | 8/1935 | Colmerauer | |
| 2,078,426 | A | 4/1937 | Sweet | |
| 2,956,626 | A | 10/1960 | Hall | |
| 3,029,038 | A | 4/1962 | Lotz | |
| 3,036,855 | A | 5/1962 | Siracusa | |
| 3,096,822 | A | 7/1963 | Hall | |
| 3,129,759 | A | 4/1964 | Tillman | |
| 3,242,985 | A | 3/1966 | North | |
| 3,800,871 | A | 4/1974 | Watson | |
| 5,370,183 | A * | 12/1994 | Ellis | E21B 17/05 166/277 |
| 2008/0156479 | A1 | 7/2008 | Cassidy et al. | |
| 2009/0146442 | A1 | 6/2009 | Kelso | |
| 2011/0272164 | A1* | 11/2011 | Surjaatmadja | E21B 4/18 166/381 |
| 2014/0090846 | A1* | 4/2014 | Deutch | E21B 29/00 166/297 |
| 2015/0308207 | A1 | 10/2015 | Mccormick | |

* cited by examiner

WELLBORE PARTED CASING ACCESS TOOL

FIELD OF INVENTION

This specification relates to wellbore work-over tools.

BACKGROUND

In hydrocarbon production, a wellbore is drilled into a hydrocarbon-rich geologic formation. The wellbore is completed to create a producing well. Wellbore completions can be either cased or open hole completions. A cased completion has steel piping cemented to the walls of the wellbore, while an open-hole completion has exposed rock from the geologic formation as a wall of the well. In some cases, an injection well can also be drilled into a geologic formation to maintain pressure on a hydrocarbon bearing region during production.

SUMMARY

This specification describes technologies relating to wellbore parted casing access tools.

An example implementation of the subject matter described within this disclosure is a method with the following features. A wellbore tool is positioned in a wellbore in which a portion of a casing located downhole within the wellbore has parted resulting in a parted casing. The wellbore tool includes a rotatable elongate pipe that includes a first elongate portion extending along a longitudinal axis of the elongate pipe. A first bending portion with a first end attaches to a downhole end of the first elongate portion. The first bending portion deviates from a longitudinal axis of the first elongate portion in a first direction. A second bending portion has a first end attached to a second end of the first bending portion. The second bending portion is positioned downhole of the first bending portion. The second bending portion deviates towards the longitudinal axis in a second direction different from the first direction. The first bending portion and the second bending are eccentric relative to the first elongate portion. A mule shoe is positioned at a second, downhole end of the second bending portion. The mule shoe is oriented to face towards a central longitudinal axis of the wellbore. The mule shoe locates an uphole end of the parted casing. The wellbore tool is lowered to a specified depth within the wellbore. The wellbore tool is rotated a set amount and stabbed in a downhole direction until the wellbore tool enters the parted casing.

Aspects of the example method, which can be combined with the example method alone or in combination, include the following. The parted casing can be eccentric relative to the central longitudinal axis of the wellbore. Rotating the wellbore tool the set amount can include rotating the wellbore tool until the mule shoe is vertically aligned with an uphole end of the parted casing.

Aspects of the example method, which can be combined with the example method alone or in combination, include the following. Rotating the wellbore tool the set amount can include rotating the wellbore tool substantially 10°.

Aspects of the example method, which can be combined with the example method alone or in combination, include the following. The parted casing can be accessed.

Aspects of the example method, which can be combined with the example method alone or in combination, include the following. Rotating the wellbore tool a set amount and stabbing the wellbore tool can both repeated in sequence until the parted casing is accessed.

Aspects of the example method, which can be combined with the example method alone or in combination, include the following. A fluid can be pumped through the wellbore tool and into the parted casing.

Aspects of the example method, which can be combined with the example method alone or in combination, include the following. The fluid can include cement.

Aspects of the example method, which can be combined with the example method alone or in combination, include the following. The wellbore can be plugged with cement. The wellbore can be abandoned.

An example implementation of the subject matter described within this disclosure is a second method with the following features. It is determined that a portion of casing positioned downhole in a wellbore has parted from a remainder of the casing. An uphole end of the portion of the casing is eccentric relative to a center of the remainder of the casing. A rotatable wellbore tool, that includes an S-shaped bend nearer a downhole end of the wellbore tool than an uphole end of the wellbore tool, is lowered into the wellbore and toward the portion of the casing. The rotatable wellbore tool is incrementally rotated and stabbed in a downhole direction to access the portion of the casing. Cement is pumped into the portion of the casing from a topside facility through the wellbore tool. The wellbore is plugged with the cement. The wellbore is abandoned.

An example implementation of the subject matter described within this disclosure is a wellbore tool with the following features. A rotatable elongate pipe is capable of being placed in a wellbore. The elongate pipe includes a first elongate portion extending along a longitudinal axis of the elongate pipe. A first bending portion is attached to a downhole end of the first elongate portion. The first bending portion deviates from a longitudinal axis of the first elongate portion in a first direction. A second bending portion is attached to an end of the first bending portion. The second bending portion is positioned downhole of the first bend. The second bending portion deviates from the longitudinal axis in a second direction different from the first direction. The first bending portion and the second bending portion are eccentric relative to the first elongate portion. A mule shoe is positioned at a downhole end of the second bending portion. The mule shoe is oriented to face towards a central longitudinal axis of the wellbore. The mule shoe locates an uphole end of the parted casing within the wellbore.

Aspects of the example wellbore tool, which can be combined with the example wellbore tool alone or in combination, include the following. The elongate pipe can include metal.

Aspects of the example wellbore tool, which can be combined with the example wellbore tool alone or in combination, include the following. When the wellbore tool is disposed within the wellbore, a first section of the wellbore tool that is uphole of the first bending portion, can be substantially parallel to the wellbore, and a second section of the wellbore tool that is downhole of the second bending portion, can also be substantially parallel to the wellbore.

Aspects of the example wellbore tool, which can be combined with the example wellbore tool alone or in combination, include the following. The first bending portion deviates away from a longitudinal axis of the elongate portion by a first angle. The second bending portion deviates towards the longitudinal axis of the elongate portion by a second angle that is substantially equal to the first angle.

Aspects of the example wellbore tool, which can be combined with the example wellbore tool alone or in combination, include the following. The first bending portion and the second bending portion can include an angle substantially 10° or less.

Aspects of the example wellbore tool, which can be combined with the example wellbore tool alone or in combination, include the following. A distance between the first bending portion and the second bending portion can be between 3 feet and 10 feet.

Aspects of the example wellbore tool, which can be combined with the example wellbore tool alone or in combination, include the following. A wellbore component can be run into the parted casing threaded through the rotatable elongate pipe.

Aspects of the example wellbore tool, which can be combined with the example wellbore tool alone or in combination, include the following. The wellbore component can be run through the rotatable elongate pipe with a wireline.

Aspects of the example wellbore tool, which can be combined with the example wellbore tool alone or in combination, include the following. The wellbore component is capable of pumping fluids from a topside facility to a well downhole of the wellbore through the rotatable elongate pipe and the parted casing.

Aspects of the example wellbore tool, which can be combined with the example wellbore tool alone or in combination, include the following. Coiled tubing can be run into the parted casing through the rotatable elongate pipe.

Aspects of the example wellbore tool, which can be combined with the example wellbore tool alone or in combination, include the following. A second wellbore tool can be attached to a downhole end of the coiled tubing.

Aspects of the example wellbore tool, which can be combined with the example wellbore tool alone or in combination, include the following. The second wellbore tool can include a logging tool.

Aspects of the example wellbore tool, which can be combined with the example wellbore tool alone or in combination, include the following. A sensor can be attached to the downhole end of the wellbore tool.

Aspects of the example wellbore tool, which can be combined with the example wellbore tool alone or in combination, include the following. The sensor can include a camera.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
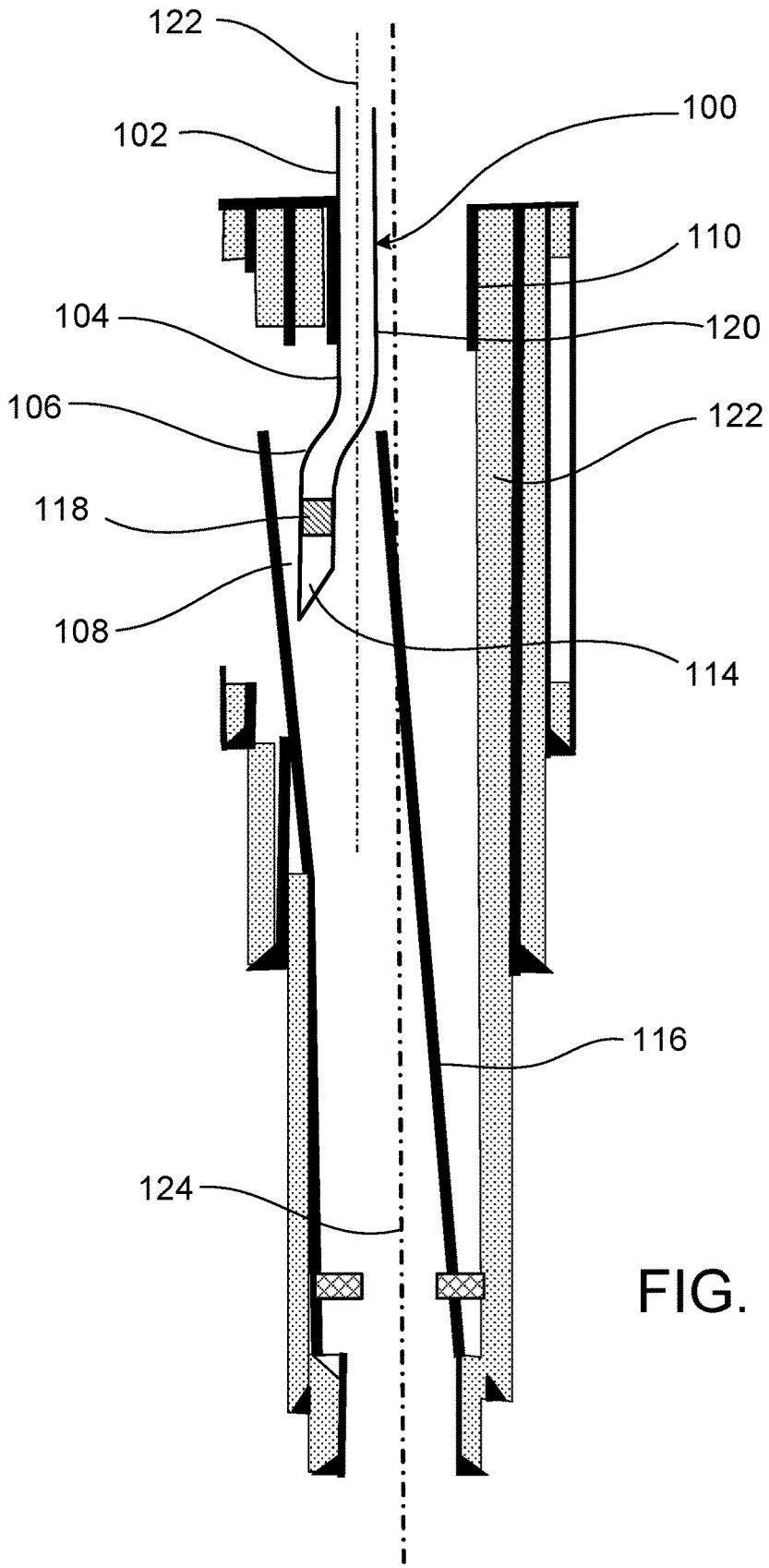
FIG. 1 shows a wellbore tool deployed in a wellbore with a parted casing.

As cased production or injection wells age, the casing within the wells can degrade. The degradation can be caused by corrosion, such as corrosion induced by $H_2S$ or another corrosion product. The degradation can also be caused by erosion, in the case of sand producing wells, or the degradation can be caused by damage during a well work-over. In some instances, improper installation can exacerbate degradation as well. In some instances, over pressure within the casing can also damage the casing. Other causes of casing damage can include earthquakes, internal movements, and fatigue of the casing.

A damaged well casing located downhole can result in a parted casing. The parted casing can be detected by pressure drop or a downhole camera. Trying to build pressure inside the well can be difficult since pressure will be release through the parted casing. Also if parted, the lower section can sometimes create a restriction preventing any pipe being tripped into the casing from a topside facility. A parted casing occurs when a lower casing section separates or splits from an upper casing section in such a way that the casing sections are no longer in-line with one another. Such a parted casing can result in fluid flow going in or out of the wellbore through a split in the parted section. The fluid flow out of the wellbore in the case of a production well can result in lost production, environmental damage, and further damage to the well. Pressurized zones deeper within the wellbore (downhole of the parted section) can pressurize a zone at the parted section of the wellbore. This can result in erosion or degradation of the zone located adjacent to the parted section. In an injection well, such a leak can prevent injection fluid from reaching a targeted injection region and could result in potential crossflow within the injection well. Cross-flow can result in erosion and degradation of the exposed section of the wellbore. Fluid ingress into the wellbore for both production and injection wells can lead to flow assurance issues, such as hydrate formations, that can further reduce production. In addition, it is possible to contaminate shallow aquifers in such an instance.

As a parted casing section is sometimes not in line with the remaining casing within the wellbore, accessing the parted casing for diagnosis, repair, and workover can be difficult. This specification describes a tool and a method for accessing a section of parted casing that is not in-line with the rest of the casing string. The tool can be implemented as a piping joint with two bends in different directions along an axis (for example, in opposing directions such as S-shaped or a differently shaped piping joint) that can fit into a section of the parted casing to access the parted casing. The tool includes a mule shoe at the downhole end to aid in guiding the piping joint into the inside of the parted casing. While a mule shoe is primarily described within this disclosure, a half mule shoe, a self-aligning mule shoe, or any other alignment mechanism can be used. In some implementations, the tool can be repeatedly stabbed in a downhole direction to enter the parted casing with the piping joint while rotating the S-shaped piping joint between each attempt.

FIG. 1 shows an example of a rotatable wellbore tool 100 accessing a parted casing section 116. In the illustrated implementation, the parted casing section 116 has fallen deeper into the wellbore 112 and damaged the cement lining the walls of the wellbore. Such a catastrophic breach causes the parted casing to deviate from the longitudinal axis 124 of the wellbore 112. Such a deviation makes it difficult for linear wellbore tools to enter the parted casing 116. The wellbore tool 100 includes a rotatable elongate pipe 102, having two opposing bends, that is designed to be deployed in a wellbore 112. The elongate pipe 102 includes a first elongate portion 120 extending along a longitudinal axis 122 of the elongate pipe 102. The first elongate portion 120 is substantially parallel to the longitudinal axis 122, which substantially passes through a center of the first elongate portion 120.

Attached to a downhole end of the first elongate portion 120 is a first bending portion 104 that deviates from the longitudinal axis 122 of the first elongate portion 120 in a first direction. When positioned within the wellbore 112, the first elongate portion 120 is substantially parallel to the wellbore 112. That is, the first elongate portion 120 is sufficiently parallel with the wellbore 112 to allow the wellbore tool 100 to travel through the wellbore 112 unobstructed. A second bending portion 106 is positioned downhole of and attached to a downhole end of the first bending portion 104. The second bending portion 106 deviates towards the longitudinal axis 122 in a second direction different from the first direction. In other words, the second bending portion 106 bends towards the longitudinal axis 122 to the point where it can be substantially parallel to the longitudinal axis 122 within reasonable machining tolerances. In some implementations, reasonable machining tolerances simply mean that the tool 100 is able to travel through the wellbore 112 without becoming lodged against the walls of the wellbore 112.

In general, the angle by which the first bending portion 104 deviates away from the longitudinal axis 122 and the angle by which the second bending portion 106 deviates towards the longitudinal axis 122 falls in a range that allows the wellbore tool 100 with both bending portions to be passed downhole into the wellbore 112. In some implementations, the bend of first bending portion 104 and the bend of the second bending portion 106 are substantially 10° or less and greater than 0°. In some implementations, the angle for the first bending portion 104 can range from 5° to 20° while the angle of the second bending portion 106 can range from 5° to 15°. In some implementations, the first bending portion 104 deviates away from a longitudinal axis 122 of the first elongate portion 120 by a first angle, and the second bending portion 106 deviates towards the longitudinal axis 122 of the first elongate portion 120 by a second angle that is substantially equal to the first angle. In other words, when the wellbore tool 100 is disposed within the wellbore 112, a first section of the wellbore tool 100 that is uphole of the first bending portion 104 is substantially parallel to the wellbore 112, and a second section of the wellbore tool 100 that is downhole of the second bending portion 106 is also substantially parallel to the wellbore 112. The first bending portion 104 and the second bending portion 106 make the wellbore tool 100 eccentric relative to the first elongate portion 120. In some implementations, a distance between the first bending portion 104 and the second bending portion 106 can be between 3 feet and 10 feet. In some implementations, the wellbore tool 100 can be eccentric in relation to the central longitudinal axis 124 of the wellbore 112. For example, the distance between the first bending portion 104 and the second bending portion 106 can be substantially 5 feet with substantially 3° bends between the two bending portions.

Positioned at a downhole end 108 of the second bending portion 106 is a mule shoe 114. The mule shoe 114 is a tapered end with the taper oriented to face towards a central longitudinal axis 124 of the wellbore 112. In some implementations, the mule shoe can include a substantially 45° taper within typical machining tolerances. In some implementations, the taper of the mule shoe can include a concave shape. In some implementations, the mule shoe 114 is formed by cutting a downhole end of the second bending portion 106 at an angle relative to the longitudinal axis 122. The taper of the mule shoe 114 can at least partially assist in locating and accessing an uphole end of the parted casing 116 within the wellbore 112. In some implementations, the elongate pipe 102 can be at least partially made of metal. In some implementations, the elongate pipe 102 may be at least partially made of a composite material, such as carbon fiber, fiberglass, or any other material of sufficient strength to prevent collapse, bursting, or breakage during operations.

When the wellbore tool 100 is disposed within the wellbore 112, a first section of the wellbore tool 100 that is uphole of the first bending portion 104 (the first elongate portion 120) is substantially parallel to the wellbore 112, and a second section of the wellbore tool 100 that is downhole of the second bending portion 106 is substantially parallel to the wellbore 112. That is, the first elongate portion 120 and the second section of the wellbore tool 100 that is downhole of the second bending portion 106 can be substantially parallel to one another. Substantially parallel, in the context of this disclosure, means that the component of the wellbore tool 100 can move through the wellbore 112 without snagging or interfering with the walls of the wellbore 112.

In some implementations, the wellbore tool 100 can also include a sensor 118 attached to the downhole end of the wellbore tool. The sensor 118 can include a camera or any other type of sensor. The sensor 118 can be used to assist operators in gaining access to the parted casing section 116 or otherwise assess the damage to the parted casing 116. For example, a camera would allow a drilling operator to see the split in the casing. In some implementations, the sensor 118 can read position in space or and can be used to determine or locate where the entry to parted casing is located. In some implementations, the sensor 118 can include a gyroscope. The sensor 118 can be wired or wirelessly connected to a topside facility.

Figure 2:
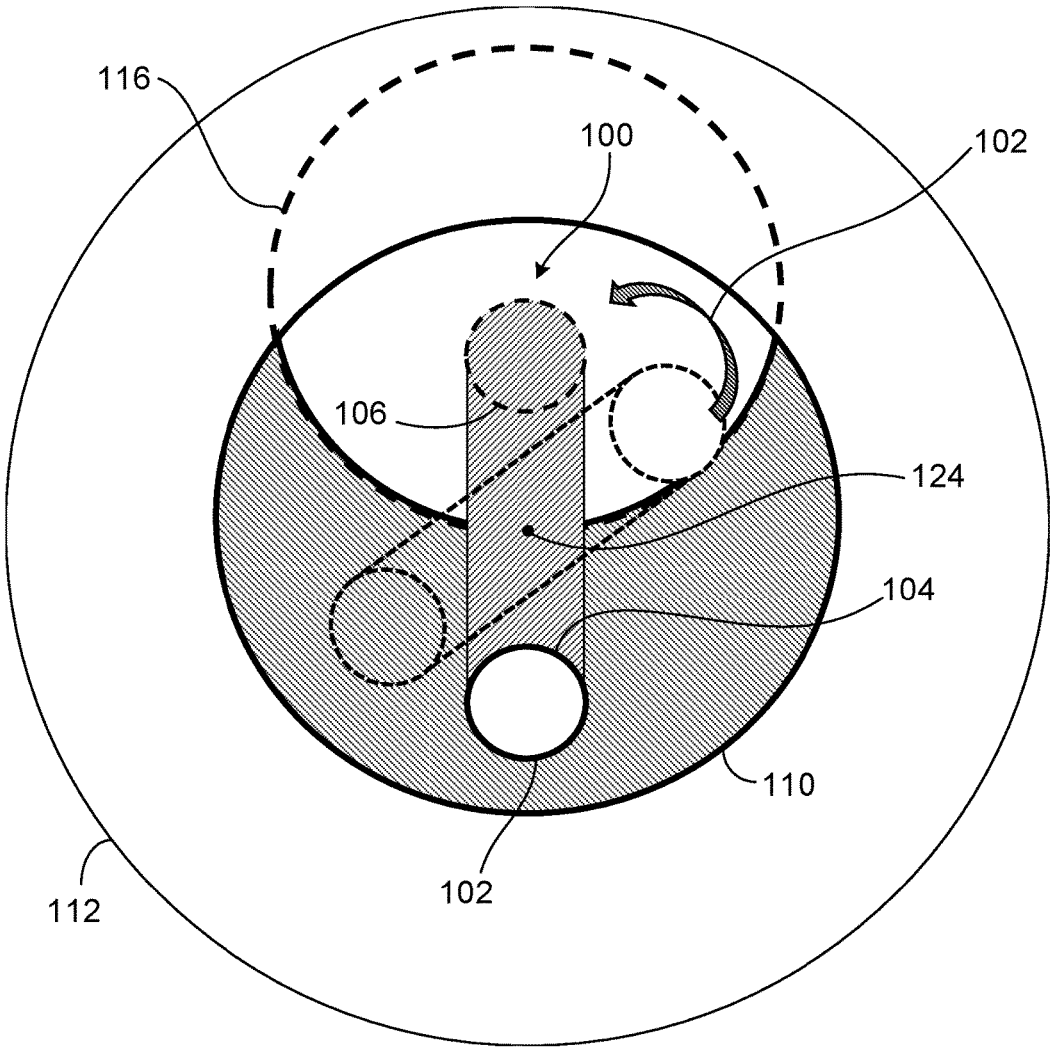
FIG. 2 shows a top-down view of a wellbore tool deployed in a wellbore with a parted casing as the wellbore tool is attempting to enter the parted casing.
Figure 3:
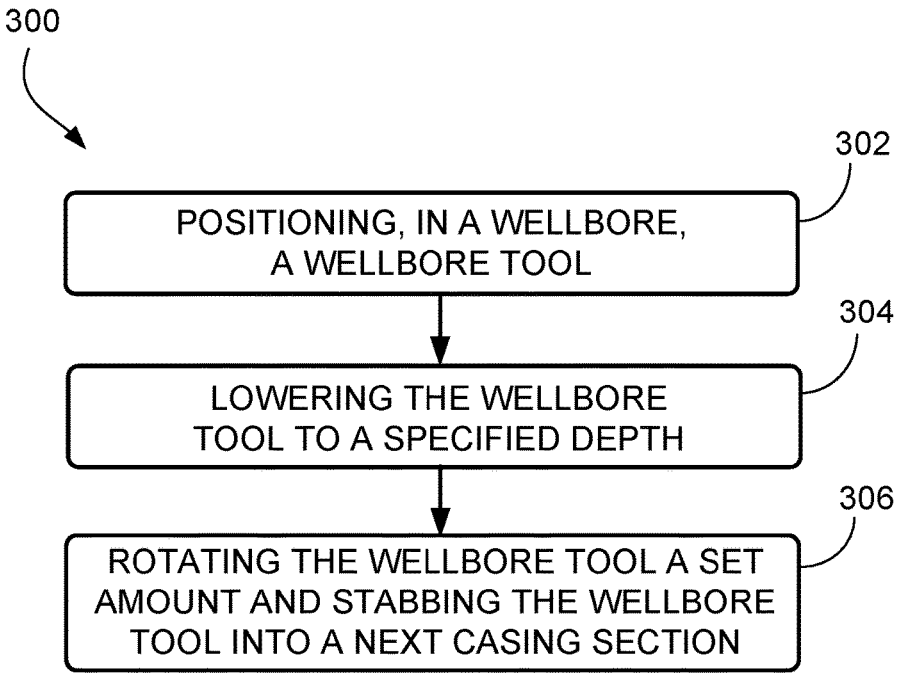
FIG. 3 is a flowchart showing an example method of inserting the wellbore tool into a parted casing.

FIG. 2 shows a top-down view of the wellbore tool 100 disposed in the wellbore 112 to access the parted casing 116. To access the casing, a method such as method 300 shown in FIG. 3 can be implemented. At 302, a wellbore tool, for example, the wellbore tool 100, is positioned in the wellbore 112 that has a portion of a casing positioned downhole that has parted and resulted in a parted casing, for example, the parted casing 116. At 304, the wellbore tool 100 is lowered to a specified depth within the wellbore 112. The specified depth can be similar to the depth of the parted casing 116.

As shown in FIG. 2, the parted casing 116 can be eccentric relative to the central longitudinal axis 124 of the wellbore 112. From a control room in a topside facility, it can be difficult to determine the proper orientation of the wellbore tool 100 to successfully access the parted casing 116. To access the casing, a trial and error approach can be used. For example, at 306, the wellbore tool 100 is rotated a set amount 202, and the wellbore tool is stabbed in the downhole direction. Step 306 is repeated until the wellbore tool enters the parted casing 116. In other words, the wellbore tool is rotated a set amount 202, such as 10° (or more or less), until the mule shoe 114 (downhole end of the tool) is vertically aligned with an uphole end of the parted casing.

Rotating the wellbore tool 100 the set amount 202 and stabbing the wellbore tool 100 are both repeated in sequence until the parted casing 116 is accessed. In some implementations, an operator can tag the same no-go depth due to the parted casing. If the operator successfully is able to run in hole and pass the same tagged depth freely, then parted casing has been successfully accessed.

Figure 4:
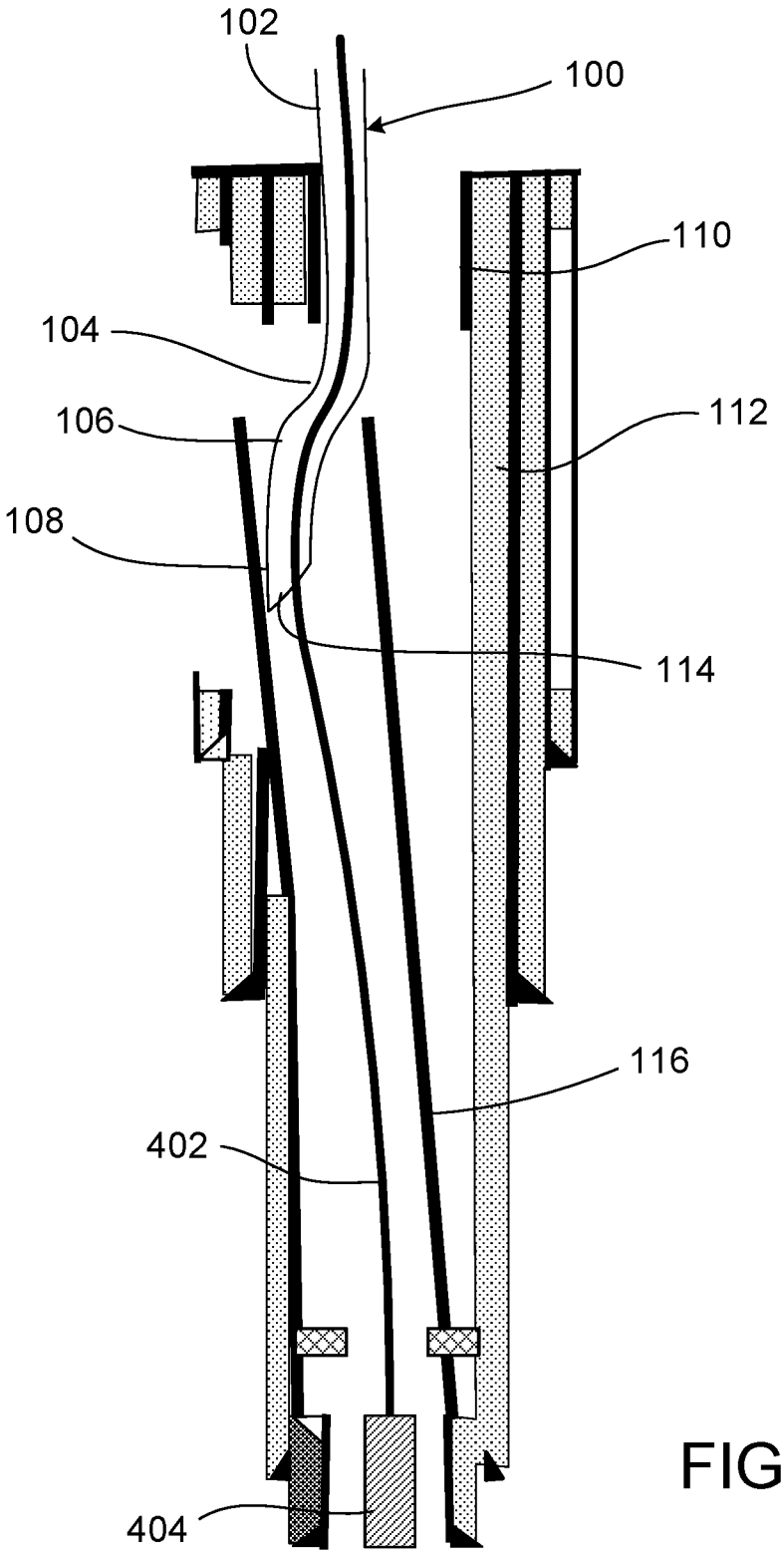
FIG. 4 shows a wellbore tool deployed in a wellbore with a wireline tool deployed through the wellbore tool.

Once the parted casing 116 has been accessed, the wellbore tool 100 can be further utilized in a variety of ways. For example, a wellbore component can be run into the parted casing through the rotatable elongate pipe 102. For example, in FIG. 4, a wellbore component 404 is configured to be run through the rotatable elongate pipe 102 with a wireline 402. The wellbore component 404 can include a sensor pack, a logging tool, a workover tool, or any other tool that can be threaded through the wellbore tool 100 with the wireline 402.

Figure 5:
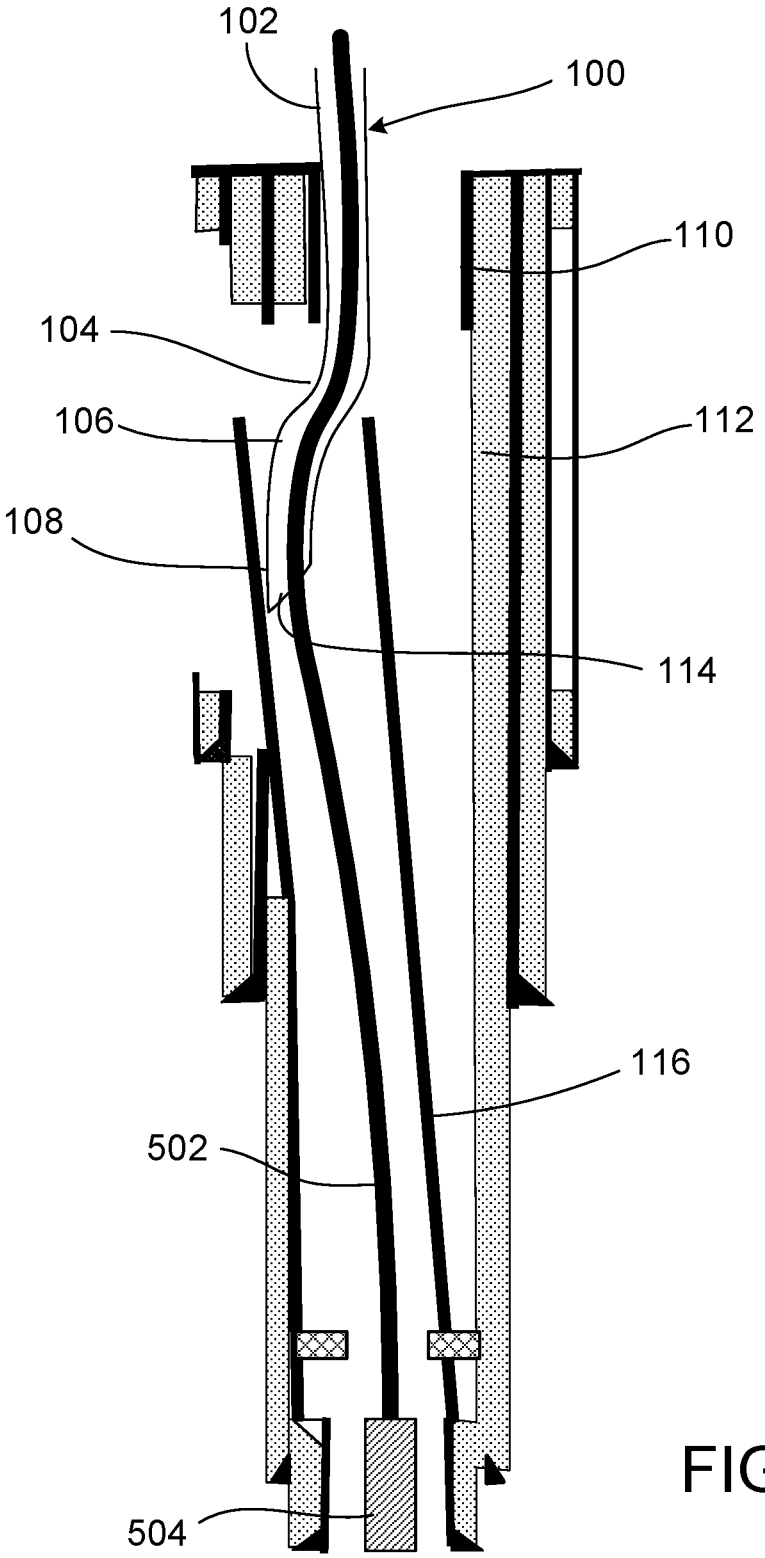
FIG. 5 shows a wellbore tool deployed in a wellbore with a coiled-tubing tool deployed through the wellbore tool.

FIG. 5 shows utilizing the wellbore tool 100 once the parted casing 116 has been accessed. In the illustrated example, coiled tubing 502 can be run into the parted casing 116 through the rotatable elongate pipe 102. In some implementations, a second wellbore tool 504 can be attached to a downhole end of the coiled tubing 502. The second wellbore tool 504 can include a sensor pack, a logging tool, a workover tool, or any other tool that can be threaded through the wellbore tool 100 with the coiled tubing 502.

Figure 6:
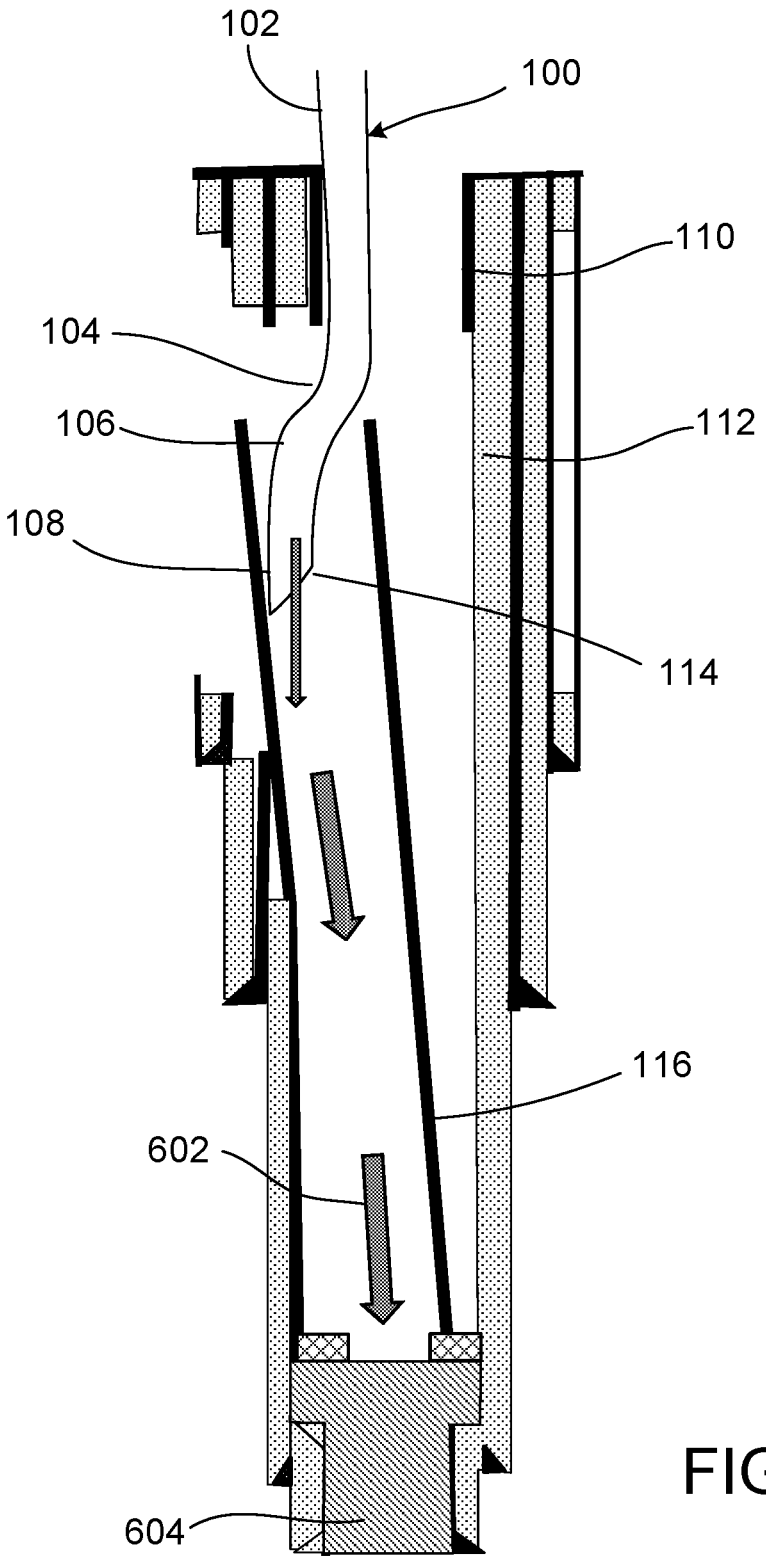
FIG. 6 shows a wellbore tool deployed in a wellbore being used to plug a wellbore.

FIG. 6 shows utilizing the wellbore tool 100 once the parted casing 116 has been accessed. The wellbore tool 100 can be hollow to allow fluids 602 to be pumped from a topside facility located at the surface of the wellbore and into the well downhole of the break in the parted casing 116. The fluids 602 can include drilling fluids, fracking fluids, or any other type of fluid. In some implementations, the fluids 602 can include cement. In such an implementation, the wellbore tool 100 can direct cement into the parted casing 116 to form a plug 604. Plugging the wellbore with cement can be done when abandoning a well.

In some implementations, the different utilizations can be combined. For example, the same wellbore tool 100 can be used to thread the wellbore component 404 on a wireline, the wellbore component 505 on coiled tubing or to pump fluids 602 downhole. In some implementations, the depth of the tool can be controlled by increasing or decreasing an amount of drill pipe sections attached to the uphole end of the wellbore tool 100.

Thus, particular implementations of the subject matter have been described. Other implementations are within the scope of the following claims.

What is claimed is:

1. A method comprising:

positioning, in a wellbore in which a portion of a casing located downhole within the wellbore has parted resulting in a parted casing, a wellbore tool comprising:

a rotatable elongate pipe comprising:

a first elongate portion extending along a longitudinal axis of the elongate pipe;

a first bending portion comprising a first end attached to a downhole end of the first elongate portion, the first bending portion deviating from a longitudinal axis of the first elongate portion in a first direction;

a second bending portion having a first end attached to a second end of the first bending portion, the second bending portion being positioned downhole of the first bending portion, the second bending portion deviating towards the longitudinal axis in a second direction different from the first direction, the first bending portion and the second bending being eccentric relative to the first elongate portion; and a mule shoe positioned at a second, downhole end of the second bending portion, the mule shoe oriented to face towards a central longitudinal axis of the wellbore, the mule shoe configured to locate an uphole end of the parted casing;

lowering the wellbore tool to a specified depth within the wellbore; and rotating the wellbore tool a set amount and stabbing in a downhole direction until the wellbore tool enters the parted casing.

2. The method of claim 1, wherein the parted casing is eccentric relative to the central longitudinal axis of the wellbore, wherein rotating the wellbore tool the set amount comprises rotating the wellbore tool until the mule shoe is vertically aligned with an uphole end of the parted casing.

3. The method of claim 1, wherein rotating the wellbore tool the set amount comprises rotating the wellbore tool substantially 10°.

4. The method of claim 1, further comprising accessing the parted casing.

5. The method of claim 4, wherein rotating the wellbore tool a set amount and stabbing the wellbore tool are both repeated in sequence until the parted casing is accessed.

6. The method of claim 5, further comprising pumping a fluid through the wellbore tool and into the parted casing.

7. The method of claim 6, wherein the fluid comprises cement.

8. The method of claim 7, further comprising:

plugging the wellbore with the cement; and abandoning the wellbore.

* * * * *